US010803806B2

(12) United States Patent
Gao et al.

(10) Patent No.: US 10,803,806 B2
(45) Date of Patent: Oct. 13, 2020

(54) PIXEL CIRCUIT AND METHOD FOR DRIVING THE SAME, DISPLAY SUBSTRATE AND METHOD FOR DRIVING THE SAME, AND DISPLAY APPARATUS

(71) Applicant: BOE TECHNOLOGY GROUP CO., LTD., Beijing (CN)

(72) Inventors: Xueling Gao, Beijing (CN); Chengchung Yang, Beijing (CN); Kuanjun Peng, Beijing (CN); Wei Qin, Beijing (CN); Xiangxiang Zou, Beijing (CN); Yang Yang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 29 days.

(21) Appl. No.: 16/332,783

(22) PCT Filed: Apr. 10, 2018

(86) PCT No.: PCT/CN2018/082503

§ 371 (c)(1),
(2) Date: Mar. 12, 2019

(87) PCT Pub. No.: WO2019/041818

PCT Pub. Date: Mar. 7, 2019

(65) Prior Publication Data

US 2019/0385530 A1 Dec. 19, 2019

(30) Foreign Application Priority Data

Aug. 30, 2017 (CN) ..... 2017 1 0769889

(51) Int. Cl.

| | |
|---|---|
| ***G09G 3/3258*** | (2016.01) |
| ***G09G 3/3233*** | (2016.01) |
| ***G09G 3/3208*** | (2016.01) |

(52) U.S. Cl.
CPC ... *G09G 3/3258* (2013.01); *G09G 2300/0426* (2013.01); *G09G 2300/0842* (2013.01); *G09G 2320/0257* (2013.01)

(58) Field of Classification Search
USPC ..... 345/691
See application file for complete search history.

(56) References Cited

U.S. PATENT DOCUMENTS

| | | | |
|---|---|---|---|
| 9,373,281 | B2 | 6/2016 | Wu et al. |
| 10,249,238 | B2 | 4/2019 | Ko et al. |

(Continued)

FOREIGN PATENT DOCUMENTS

| | | | |
|---|---|---|---|
| CN | 101882416 | A | 11/2010 |
| CN | 103106866 | A | 5/2013 |

(Continued)

OTHER PUBLICATIONS

Search Report issued in corresponding International Patent Application No. PCT/CN2018/082503, dated Jun. 28, 2018.

(Continued)

*Primary Examiner* — Chineyere D Wills-Burns
(74) *Attorney, Agent, or Firm* — McDermott Will & Emery LLP

(57) ABSTRACT

Pixel circuit and display substrate and driving methods, and display apparatus are provided. Pixel circuit includes: driving resetting sub-circuit to input voltage at first initial voltage terminal to gate of driving transistor in driving sub-circuit under control of first resetting signal terminal; writing compensation sub-circuit to input data voltage to driving sub-circuit and compensate driving sub-circuit under control of scanning signal terminal in writing compensation phase, and input reference voltage output at data voltage terminal to driving sub-circuit in blanking phase, so driving transistor in On-Bias state; light-emitting resetting sub- (Continued)

circuit to input voltage at first initial voltage terminal to light-emitting device to reset light-emitting device under control of scanning signal terminal; and light-emitting enabling sub-circuit to provide voltage at first power supply voltage terminal to driving sub-circuit and connect driving sub-circuit to light-emitting device under control of enabling signal terminal; and driving sub-circuit to provide driving current to light-emitting device.

19 Claims, 9 Drawing Sheets

(56) References Cited

U.S. PATENT DOCUMENTS

| | | | | |
|---|---|---|---|---|
| 2010/0164847 | A1* | 7/2010 | Lee | G09G 3/3233 345/77 |
| 2011/0102692 | A1* | 5/2011 | Shih | G06F 3/0412 349/38 |
| 2012/0001893 | A1* | 1/2012 | Jeong | G09G 3/3233 345/213 |
| 2015/0009199 | A1* | 1/2015 | In | G09G 3/3233 345/212 |
| 2015/0187270 | A1* | 7/2015 | Lee | G09G 3/3258 345/76 |
| 2016/0189630 | A1* | 6/2016 | Chang | G09G 3/3233 345/211 |
| 2016/0275869 | A1* | 9/2016 | Hwang | G09G 3/3258 |
| 2018/0190185 | A1* | 7/2018 | Ko | G09G 3/3233 |

FOREIGN PATENT DOCUMENTS

| | | | |
|---|---|---|---|
| CN | 103236237 | A | 8/2013 |
| CN | 105679236 | A | 6/2016 |
| CN | 106531076 | A | 3/2017 |
| CN | 106683619 | A | 5/2017 |
| CN | 107452334 | A | 12/2017 |

OTHER PUBLICATIONS

Written Opinion issued in corresponding International Patent Application No. PCT/CN2018/082503, dated Jun. 28, 2018.

First Office Action issued in corresponging Chinese Patent Application No. 201710769889.3, dated Dec. 24, 2018.

Second Office Action issued in corresponging Chinese Patent Application No. 201710769889.3, dated Apr. 10, 2019.

* cited by examiner

PIXEL CIRCUIT AND METHOD FOR DRIVING THE SAME, DISPLAY SUBSTRATE AND METHOD FOR DRIVING THE SAME, AND DISPLAY APPARATUS

CROSS-REFERENCE OF RELATED APPLICATIONS

This application is the U.S. National Phase under 35 U.S.C. § 371 of International Patent Application No. PCT/CN2018/082503, filed on Apr. 10, 2018, which in turn claims the benefit of Chinese Patent Application No. 201710769889.3, filed on Aug. 30, 2017, the entire disclosures of which Applications are incorporated by reference herein.

TECHNICAL FIELD

The present application relates to the field of display technologies, and more particularly, to a pixel circuit and a method for driving the same, a display substrate and a method for driving the same, and a display apparatus.

BACKGROUND

Organic Light-emitting Diode (OLED) displays are one of the hotspots in the current research field. Compared with Liquid Crystal Displays (LCDs), the OLEDs have advantages such as low energy consumption, low production cost, self-illumination, wide viewing angle, and corresponding high speed etc.

Analysis shows that the OLEDs may exhibit a short-term afterimage phenomenon when displaying pictures of different grayscales.

SUMMARY

Embodiments of the present application provide a pixel circuit and a method for driving the same, a display substrate and a method for driving the same, and a display apparatus, which can at least improve the short-term afterimage problem.

In order to achieve the above purposes, the embodiments of the present application adopt the following technical solutions.

In a first aspect, there is provided a pixel circuit, comprising: a driving resetting sub-circuit, a writing compensation sub-circuit, a light-emitting resetting sub-circuit, a light-emitting enabling sub-circuit, a driving sub-circuit and a light-emitting device, wherein the driving sub-circuit comprises a driving transistor having a source connected to the writing compensation sub-circuit; the driving resetting sub-circuit is connected to a first resetting signal terminal, a first initial voltage terminal and the driving sub-circuit respectively, and is configured to input a voltage provided at the first initial voltage terminal to a gate of the driving transistor in the driving sub-circuit so as to reset the driving sub-circuit under the control of the first resetting signal terminal; the writing compensation sub-circuit is connected to a scanning signal terminal, a data voltage terminal and the driving sub-circuit respectively, and is configured to input a data voltage output at the data voltage terminal to the driving sub-circuit and perform data compensation on the driving sub-circuit under the control of the scanning signal terminal; and configured to input a reference voltage output at the data voltage terminal to the driving sub-circuit under the control of the scanning signal terminal so that the driving transistor is in an on-bias state when the driving resetting sub-circuit inputs the voltage provided at the first initial voltage terminal to the gate of the driving transistor in the driving sub-circuit so as to reset the driving sub-circuit under the control of the first resetting signal terminal; the light-emitting resetting sub-circuit is connected to the scanning signal terminal, the first initial voltage terminal and the light-emitting device respectively, and is configured to input the voltage provided at the first initial voltage terminal to the light-emitting device so as to reset the light-emitting device under the control of the scanning signal terminal; the light-emitting enabling sub-circuit is connected to an enabling signal terminal, a first power supply voltage terminal, the driving sub-circuit and the light-emitting device respectively, and is configured to provide a voltage at the first power supply voltage terminal to the driving sub-circuit and connect the driving sub-circuit to the light-emitting device under the control of the enabling signal terminal; and the driving sub-circuit is configured to provide a driving current to the light-emitting device.

Alternatively, the driving sub-circuit is further connected to the first power supply voltage terminal; the driving sub-circuit further comprises a storage capacitor; the gate of the driving transistor is electrically connected to the driving resetting sub-circuit and the writing compensation sub-circuit, and a first electrode and a second electrode of the driving transistor are both electrically connected to the light-emitting enabling sub-circuit and the writing compensation sub-circuit; and the storage capacitor has a terminal electrically connected to the gate of the driving transistor, and another terminal electrically connected to the first power supply voltage terminal.

Alternatively, the driving resetting sub-circuit comprises a first transistor, wherein the first transistor has a gate electrically connected to the first resetting signal terminal, a first electrode electrically connected to the gate of the driving transistor, and a second electrode electrically connected to the first initial voltage terminal.

Alternatively, the writing compensation sub-circuit comprises a second transistor and a third transistor, wherein the second transistor has a gate electrically connected to the scanning signal terminal, a first electrode electrically connected to the gate of the driving transistor, and a second electrode electrically connected to a drain of the driving transistor; and the third transistor has a gate electrically connected to the scanning signal terminal, a first electrode electrically connected to the data voltage terminal, and a second electrode electrically connected to the source of the driving transistor.

Alternatively, the light-emitting resetting sub-circuit comprises a fourth transistor, wherein the fourth transistor has a gate electrically connected to the scanning signal terminal, a first electrode electrically connected to the first initial voltage terminal, and a second electrode electrically connected to the light-emitting device.

Alternatively, the light-emitting enabling sub-circuit comprises a fifth transistor and a sixth transistor, wherein the fifth transistor has a gate electrically connected to the enabling signal terminal, a first electrode electrically connected to the first power supply voltage terminal, and a second electrode electrically connected to the source of the driving transistor; and the sixth transistor has a gate electrically connected to the enabling signal terminal, a first electrode electrically connected to the drain of the driving transistor, and a second electrode electrically connected to the light-emitting device.

Alternatively, the light-emitting device comprises a light-emitting diode, wherein the light-emitting diode has an anode electrically connected to the light-emitting enabling sub-circuit and the light-emitting resetting sub-circuit, and a cathode electrically connected to the second power supply voltage terminal.

In a second aspect, there is provided a display substrate, comprising sub-pixels disposed in an array, wherein each of the sub-pixels comprises the pixel circuit according to the first aspect.

Alternatively, the scanning signal terminals of all the pixel circuits in a row of sub-pixels are all connected to a gate line; the display substrate further comprises at least one switching sub-circuit, wherein each of the at least one switching sub-circuit is connected to a gate line, and all of the at least one switching sub-circuit is connected to a second resetting signal terminal and a second initial voltage terminal; and the switching sub-circuit is configured to input a voltage provided at the second initial voltage terminal to the gate line under the control of the second resetting signal terminal, so that the writing compensation sub-circuit inputs a data voltage output at the data voltage terminal to the driving sub-circuit in a blanking phase.

Further, each of the at least one switching sub-circuit comprises a seventh transistor, wherein the seventh transistor has a gate electrically connected to the second resetting signal terminal, a first electrode electrically connected to the gate line, and a second electrode electrically connected to the second initial voltage terminal.

In a third aspect, there is provided a display apparatus, comprising the display substrate according to the second aspect.

In a fourth aspect, there is provided a method for driving the pixel circuit according to the first aspect, comprising: in a resetting phase of an image frame, resetting, by the driving resetting sub-circuit, the driving sub-circuit through the first initial voltage terminal under the control of the first resetting signal terminal; in a writing compensation phase of the image frame, providing, by the writing compensation sub-circuit, a data voltage to the driving sub-circuit through the data voltage terminal, and performing data compensation on the driving sub-circuit under the control of the scanning signal terminal, while resetting, by the light-emitting resetting sub-circuit, the light-emitting device through the first initial voltage terminal under the control of the scanning signal terminal; in a light-emitting phase of the image frame, providing, by the light-emitting enabling sub-circuit, a voltage provided at the first power supply voltage terminal to the driving sub-circuit, and connecting the driving sub-circuit to the light-emitting device under the control of the enabling signal terminal, so that the driving sub-circuit provides a driving current to the light-emitting device; and in a blanking phase between adjacent image frames, resetting, by the driving resetting sub-circuit, the driving sub-circuit through the first initial voltage terminal under the control of the first resetting signal terminal, while providing, by the writing compensation sub-circuit, a reference voltage to the driving sub-circuit through the data voltage terminal under the control of the scanning signal terminal, so that the driving transistor in the driving sub-circuit is in an On-Bias state.

In a fifth aspect, there is provided a method for driving a display substrate, wherein the display panel comprises sub-pixels, wherein each of the sub-pixels comprises the pixel circuit according to the first aspect; the display panel further comprises at least one switching sub-circuit, wherein each of the at least one switching sub-circuit is connected to a gate line, and all of the at least one switching sub-circuit is connected to a second resetting signal terminal and a second initial voltage terminal.

The method for driving a display panel comprises: in a resetting phase of an image frame, resetting by, the driving resetting sub-circuit, the driving sub-circuit through the first initial voltage terminal under the control of the first resetting signal terminal; in a writing compensation phase of the image frame, providing, by the writing compensation sub-circuit, a data voltage to the driving sub-circuit through the data voltage terminal, and performing data compensation on the driving sub-circuit under the control of the scanning signal terminal; and resetting, by the light-emitting resetting sub-circuit, the light-emitting device through the first initial voltage terminal under the control of the scanning signal terminal; in a light-emitting phase of the image frame, providing, by the light-emitting enabling sub-circuit, a voltage provided at the first power supply voltage terminal to the driving sub-circuit, and connecting the driving sub-circuit to the light-emitting device under the control of the enabling signal terminal, so that the driving sub-circuit provides a driving current to the light-emitting device; and in a blanking phase between adjacent image frames, resetting, by the driving resetting sub-circuit, the driving sub-circuit through the first initial voltage terminal under the control of the first resetting signal terminal, while inputting a voltage provided at the second initial voltage terminal to the gate line through a switch sub-circuit under the control of the second resetting signal terminal, so that the writing compensation sub-circuit provides a reference voltage to the driving sub-circuit through the data voltage terminal, to cause the driving transistor in the driving sub-circuit to be in an On-Bias state.

BRIEF DESCRIPTION OF THE ACCOMPANYING DRAWINGS

In order to more clearly illustrate the technical solutions in the embodiments of the present application or the related art, the accompanying drawings to be used in the description of the embodiments or the related art will be briefly described below. Obviously, the accompanying drawings in the following description are only some embodiments of the present application, and other accompanying drawings may further be obtained by those of ordinary skill in the art according to these accompanying drawings without any creative effort.

Figure 4:
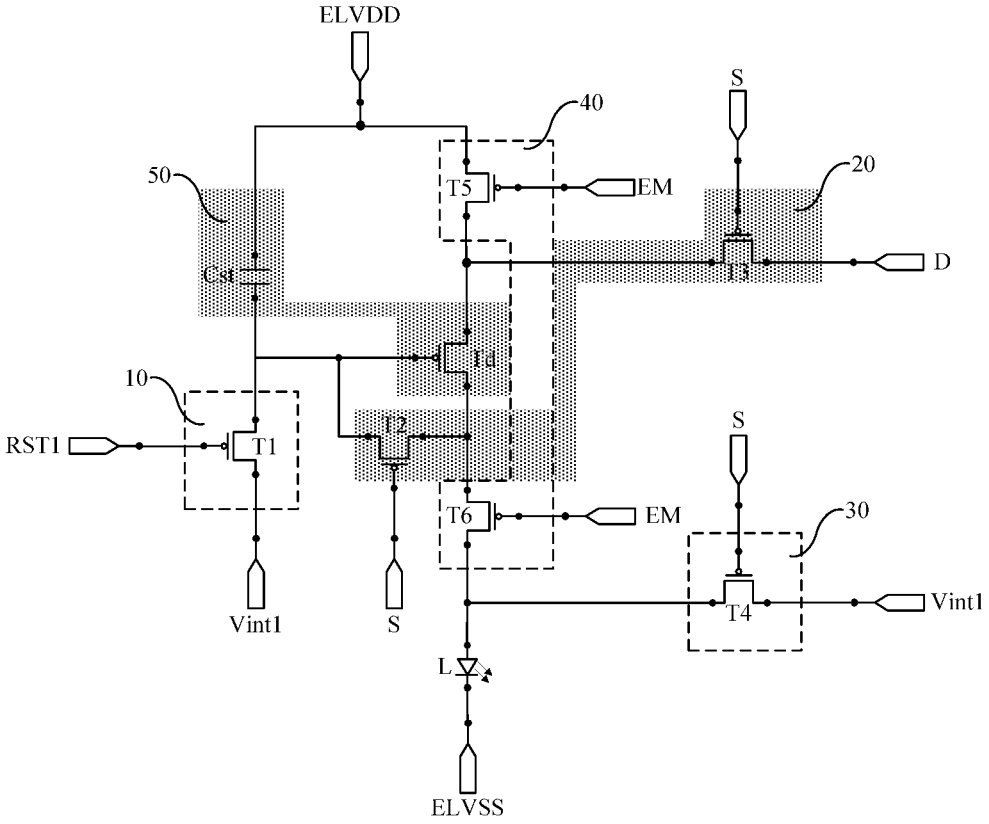
FIG. 4 is a specific schematic structural diagram of sub-circuits of the pixel circuit shown in FIG. 2.
Figure 6:
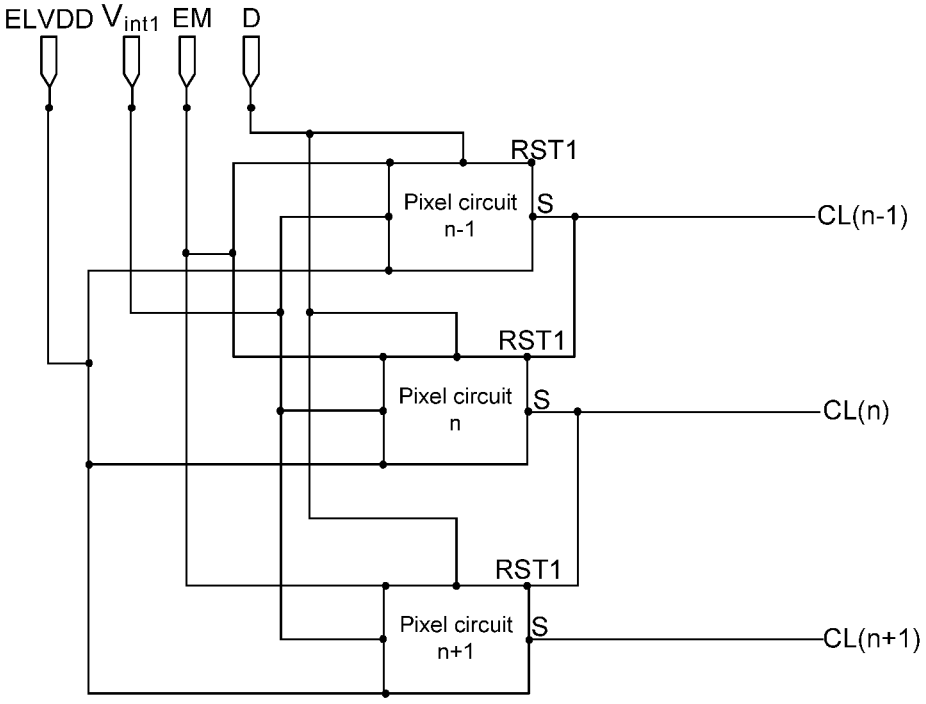
Figure 7:
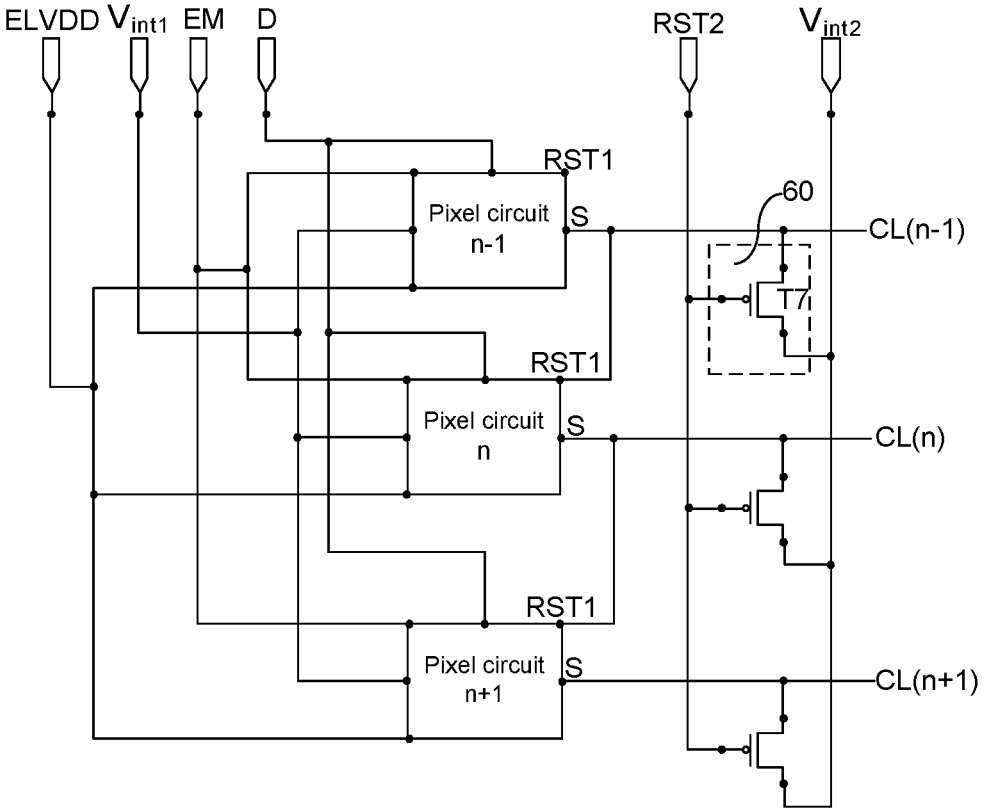
Figure 8:
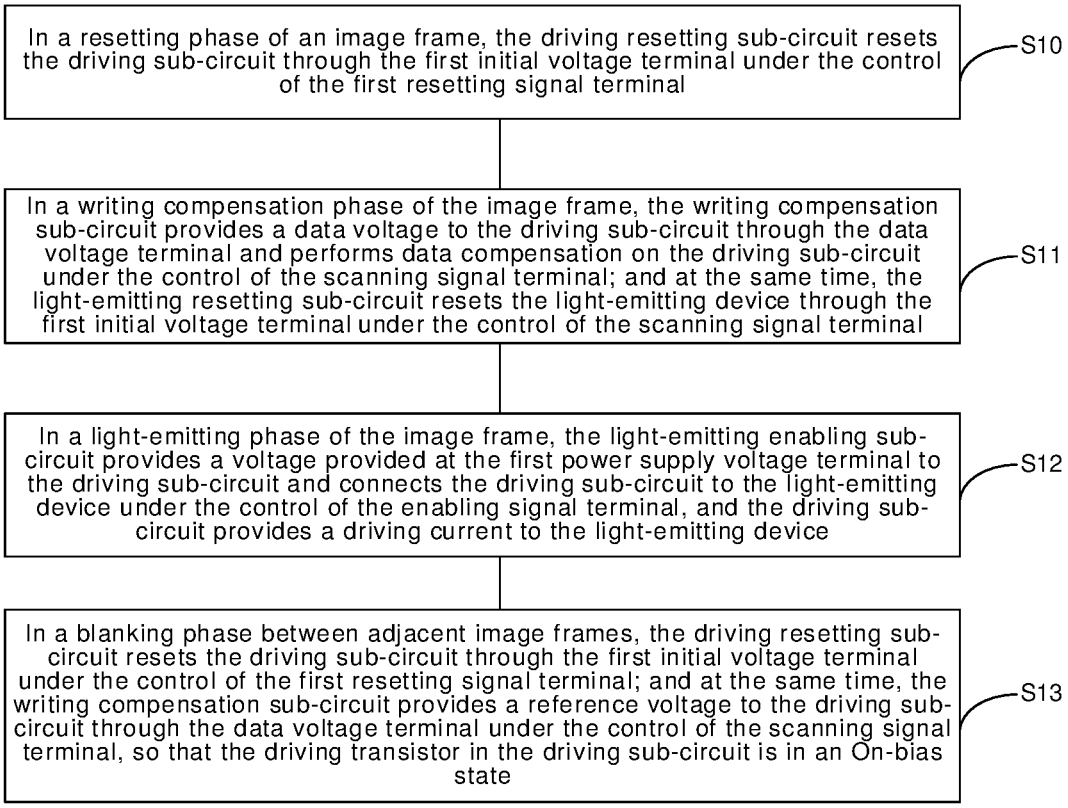
Figure 9:
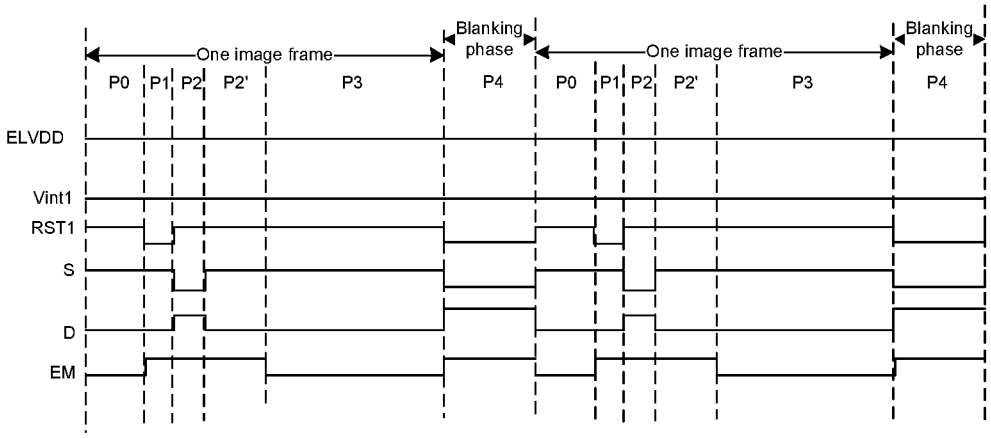
Figure 10:
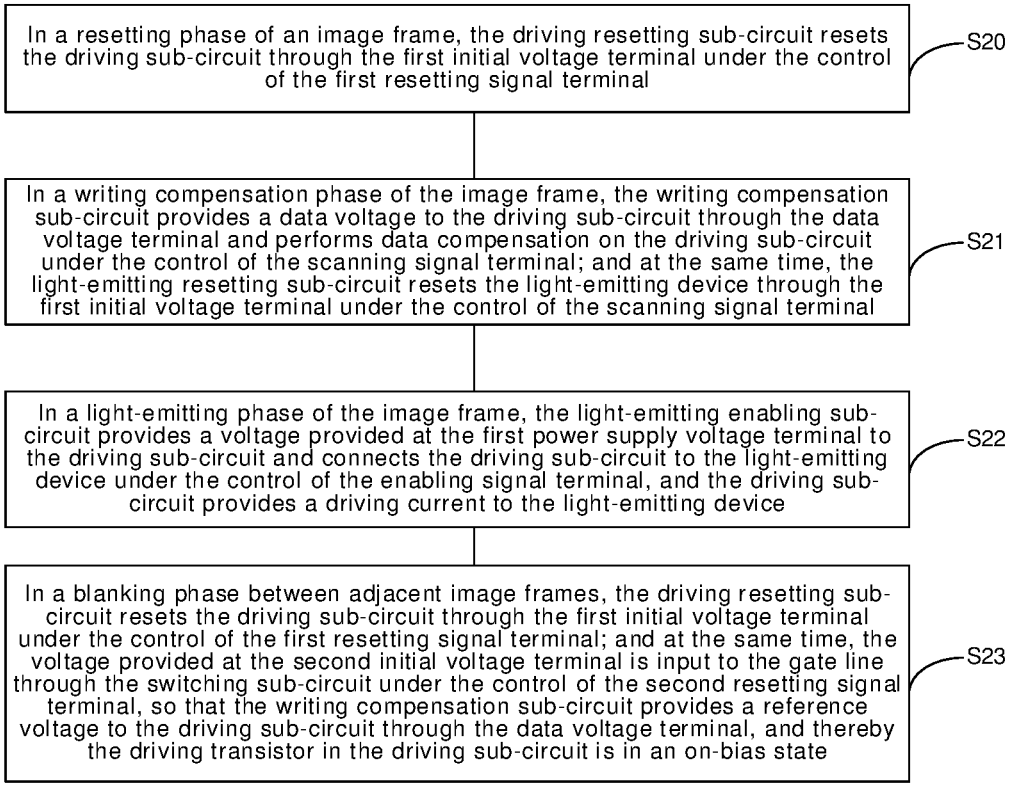
Figure 11:
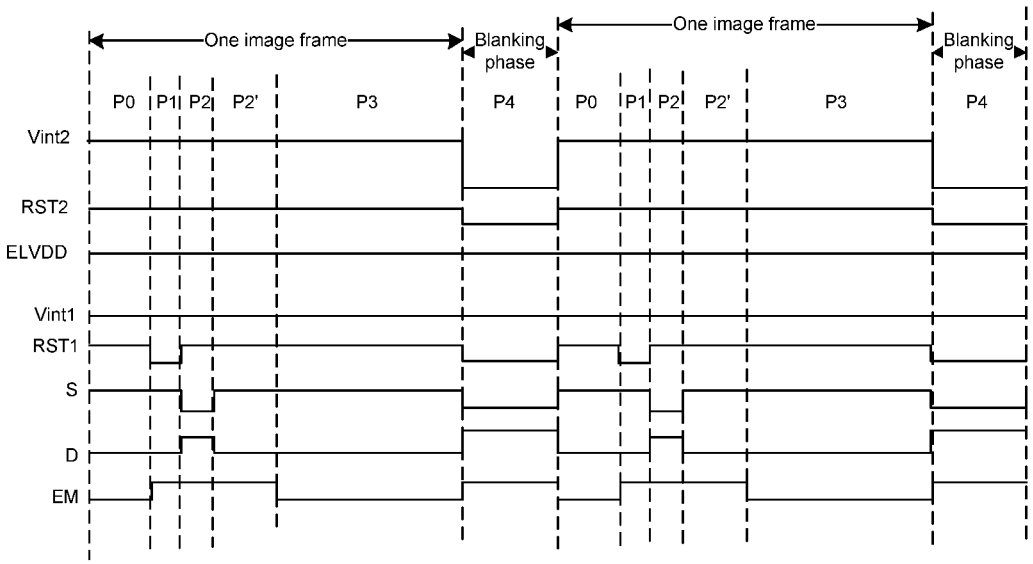

FIGS. 5*a*-5*d* are equivalent circuit diagrams of the pixel circuit shown in FIG. 4 in different situations;

FIG. 6 is a first schematic diagram of a display substrate according to the present application;

FIG. 7 is a second schematic diagram of a display substrate according to the present application;

FIG. 8 is a first schematic flowchart of a method for driving a display substrate according to the present application;

FIG. 9 is a first timing diagram of signals used when driving a pixel circuit;

FIG. 10 is a second schematic flowchart of a method for driving a display substrate according to the present application; and FIG. 11 is a second timing diagram of signals used when driving a pixel circuit.

DETAILED DESCRIPTION

The technical solutions in the embodiments of the present application will be clearly and completely described below with reference to the accompanying drawings in the embodiments of the present application. It is obvious that the embodiments described are only a part of the embodiments of the present application, instead of all the embodiments. All other embodiments obtained by those of ordinary skill in the art based on the embodiments of the present application without any creative effort shall fall within the protection scope of the present application.

Figure 1:
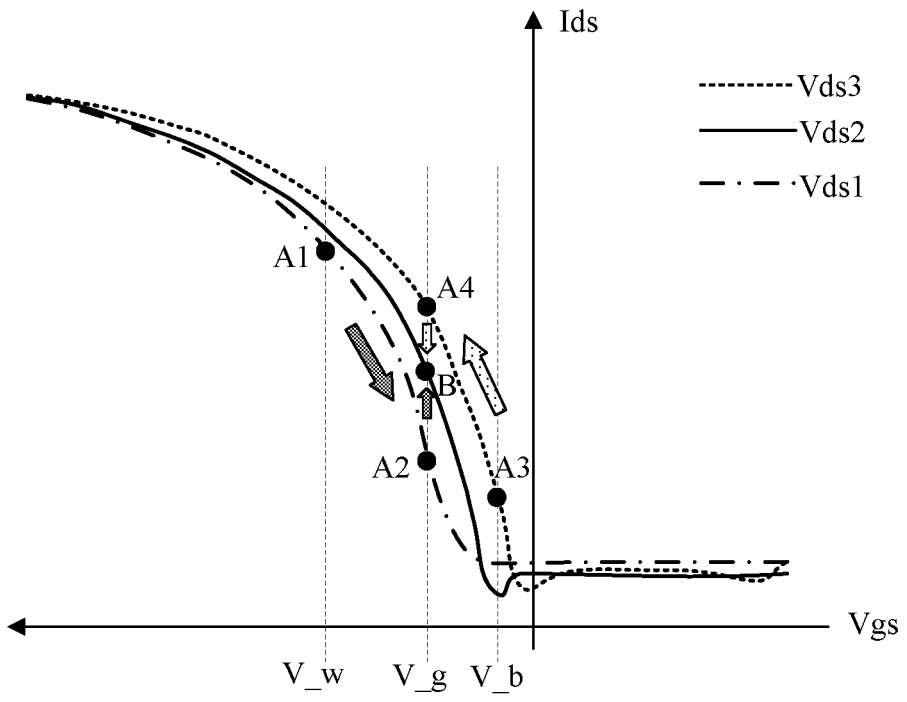
FIG. 1 is a schematic diagram of a hysteresis effect in the related art.

The short-term afterimage phenomenon is related to a hysteresis effect of a driving transistor in an OLED display. A process of the hysteresis effect is as shown in FIG. 1, wherein the dotted line in FIG. 1 is a characteristic curve of the current Ids with respect to a gate-source voltage (Vgs) of a driving transistor in a sub-pixel when a source-drain voltage of the driving transistor is Vds1 in a process of displaying at a maximum grayscale in an OLED display; the broken line in FIG. 1 is a characteristic curve of the current Ids with respect to Vgs of the driving transistor in the sub-pixel when the source-drain voltage of the driving transistor is Vds3 in a process of displaying at a minimum grayscale; and the solid line in FIG. 1 is a characteristic curve of the current with respect to Vgs of the driving transistor in the sub-pixel when the source-drain voltage of the driving transistor is Vds2 in a process of displaying at an intermediate grayscale.

When a picture of the maximum grayscale is switched to a picture of the intermediate grayscale, the driving current Ids in the sub-pixel when the picture of the maximum grayscale is displayed needs to be reduced. Therefore, hole detrapping will occur on an interface between a semiconductor layer and a gate insulating layer of the driving transistor in the sub-pixel, and at the time, a value of Vgs changes from V_w at point A1 to V_g at point A2. When a picture of the minimum grayscale is switched to a picture of the intermediate grayscale, the driving current Ids of the driving transistor in the sub-pixel when the picture of the minimum grayscale is displayed needs to be increased. Therefore, hole trapping will occur on the interface between the semiconductor layer and the gate insulating layer of the driving transistor in the sub-pixel, and at the time, the value of Vgs changes from V_b at point A3 to V_g at point A4. It can be seen that paths for the voltage change during the hole trapping process and the hole detrapping process are different, and therefore, the different paths along which voltage V_g at point A2 and the point A4 is reached correspond to different driving currents Ids respectively. As a result, there is a difference between brightness of the sub-pixel of the picture of the intermediate grayscale that is switched from the picture of the maximum grayscale and brightness of the sub-pixel of the picture of the intermediate grayscale that is switched from the picture of the minimum grayscale, which results in a short-term afterimage phenomenon. The different driving currents Ids change from the above points A2 and A4 to point B after a period of time, and the afterimage disappears.

Figure 2:
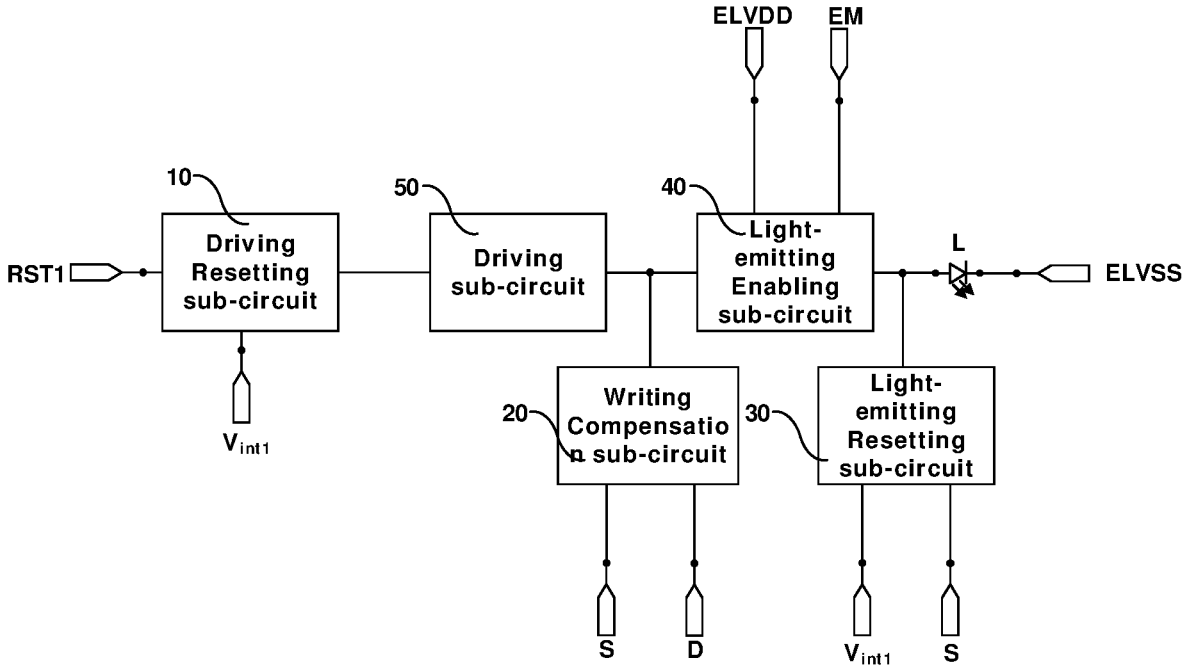
FIG. 2 is a schematic structural diagram of a pixel circuit according to the present application.

The embodiments of the present application provide a pixel circuit, as shown in FIG. 2, comprising: a driving resetting sub-circuit 10, a writing compensation sub-circuit 20, a light-emitting resetting sub-circuit 30, a light-emitting enabling sub-circuit 40, a driving sub-circuit 50 and a light-emitting device L. The driving sub-circuit 50 comprises a driving transistor Td (an example thereof is shown below in conjunction with FIG. 4), having a source connected to the writing compensation sub-circuit 20.

Specifically, the resetting sub-circuit 10 is connected to a first resetting signal terminal RST1, a first initial voltage terminal $V_{int1}$ and the driving sub-circuit 50 respectively, and is configured to input a voltage provided at the first initial voltage terminal $V_{int1}$ to the driving sub-circuit 50 so as to reset the driving sub-circuit 50 under the control of the first resetting signal terminal RST1.

The writing compensation sub-circuit 20 is connected to a scanning signal terminal S, a data voltage terminal D and the driving sub-circuit 50 respectively, and is configured to input, under the control of the scanning signal terminal S, a reference voltage output at the data voltage terminal D to the driving sub-circuit 50 in a blanking phase, so that the driving transistor Td is in an On-Bias state in the blanking phase, and input a data voltage output at the data voltage terminal D to the driving sub-circuit 50 and perform data compensation on the driving sub-circuit 50 in a writing compensation phase.

The light-emitting resetting sub-circuit 30 is connected to the scanning signal terminal S, the first initial voltage terminal $V_{int1}$ and an anode of the light-emitting device L respectively, and is configured to input the voltage provided at the first initial voltage terminal $V_{int1}$ to the light-emitting device L so as to reset the light-emitting device L under the control of the scanning signal terminal S. A cathode of the light-emitting device L is connected to a second power supply voltage terminal ELVSS.

The light-emitting enabling sub-circuit 40 is connected to an enabling signal terminal EM, a first power supply voltage terminal ELVDD, the driving sub-circuit 50 and the light-emitting device L respectively, and is configured to provide a voltage at the first power supply voltage terminal ELVDD to the driving sub-circuit 50 and connect the driving sub-circuit 50 to the light-emitting device L under the control of the enabling signal terminal EM.

The driving sub-circuit 50 is configured to provide a driving current to the light-emitting device L.

Description will be made below by taking a P-type driving transistor Td as an example. It should be noted that the driving transistor Td has a relatively large size and has a certain driving capability. Therefore, the driving transistor Td may provide the driving current to the light-emitting device L to drive the light-emitting device L to emit light with the output voltage at the first power supply voltage terminal ELVDD which is provided by the light-emitting enabling sub-circuit 40.

It can be understood that the blanking phase is a time period between adjacent image frames, and during the time period, a residual image of a previous frame is eliminated. For any image frame, it is progressively scanned from a first row of gate line to a last row of gate line. Therefore, the blanking phase occurs after a last row of gate line of a previous image frame is scanned completely and a last row of sub-pixels of the previous image frame completes the display and before a first row of gate line of a next image frame start to be scanned.

The embodiments of the present application provide a pixel circuit, in which the writing compensation sub-circuit 20 inputs the data voltage output at the data voltage terminal D to the driving transistor Td in the driving sub-circuit 50, and performs data compensation on the driving transistor Td in the writing compensation phase, so that when the driving transistor Td drives the light-emitting device L to emit light, the current flowing through the light-emitting device L is independent of a threshold voltage of the driving transistor Td, thereby eliminating the influence of the threshold voltage on light-emitting brightness, and improving display uniformity. Further, in the blanking phase, the voltage provided at the first initial voltage terminal $V_{int1}$ is input to the gate of the driving transistor Td, and at the same time, the reference voltage (denoted as $V_D$) output at the data voltage terminal D is input to the source of the driving transistor. In this way, Vgs of all the driving transistors Td of the display panel can be reset at the same time (to $V_{int1}$-$V_D$), and thereby the driving transistors Td are in an On-Bias state, that is, all the driving transistors Td are in the same hole trapping state. Therefore, writing and compensation of the data voltage are performed on the driving transistors Td in the same state regardless of a data voltage of a previous frame, thereby improving the short-term afterimage problem caused by the hysteresis effect.

Figure 3:
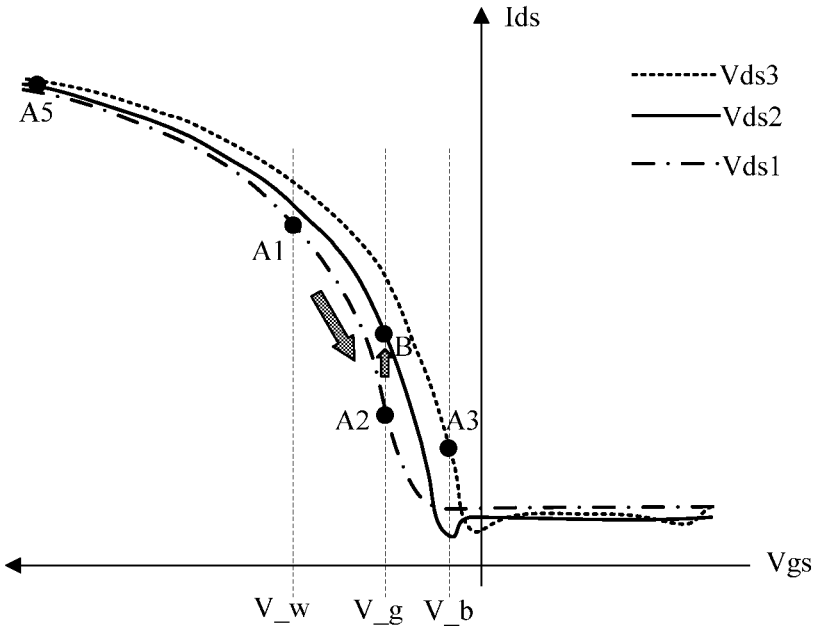
FIG. 3 is a schematic diagram of a hysteresis effect according to the present application.

For example, by taking a case it switches from a picture of a maximum grayscale and a picture of a minimum grayscale to a picture of an intermediate grayscale respectively as an example, as shown in FIG. 3, the driving transistors Td in the pixel circuits of the sub-pixels in the display panel are in an On-Bias state in the blanking phase in both cases. At this time, the driving transistors Td have the same Vgs, which is located at an uppermost end of characteristic curves, and corresponds to the same large current Ids (corresponding to point A5 in FIG. 3). That is, for a sub-pixel that displays at the maximum grayscale, it reaches point A5 from point A1, and for a sub-pixel that displays at the minimum grayscale, it reaches point A5 from point A3. The driving transistors Td in the sub-pixels are in the same hole trapping state in both cases. Based thereon, when a next image frame is displayed, the current Ids of a driving transistor in each sub-pixel needs to be reduced, and therefore, hole detrapping will occur on an interface between a semiconductor layer and a gate insulating layer of the driving transistor Td in each sub-pixel, and the driving transistors Td have the same hole detrapping path in both cases. In this way, the short-term afterimage problem caused by the hysteresis effect can be improved, and the light-emitting brightness can reach the light-emitting brightness corresponding to the point B, which is consistent with the brightness corresponding to an actual grayscale.

As shown in FIG. 4, the driving sub-circuit 50 is further connected to the first power supply voltage terminal ELVDD. Here, the driving sub-circuit 50 comprises a storage capacitor $C_{st}$ in addition to the driving transistor Td.

Here, the driving transistor Td has a gate electrically connected to the driving resetting sub-circuit 10 and the writing compensation sub-circuit 20, and a source and a drain both electrically connected to the light-emitting enabling sub-circuit 40 and the writing compensation sub-circuit 20.

The storage capacitor Cst has a terminal electrically connected to the gate of the driving transistor Td, and another terminal electrically connected to the first power supply voltage terminal ELVDD.

It should be noted that the driving sub-circuit 50 may further comprise a plurality of driving transistors Td connected in parallel. The above description is merely an example of the driving sub-circuit 50. Other structures having the same functions as those of the driving sub-circuit 50 will not be described here again, and should fall within the protection scope of the present application.

Description will be made below by taking transistors other than the driving transistor being P-type transistors as an example, and each of the P-type transistors is turned on when a low level signal is input at a gate thereof. A first electrode of the P-type transistor is one of a source and a drain, and a second electrode of the P-type transistor is the other of the source and the drain which is different from the first electrode. Of course, the transistors other than the driving transistor may also be other types of transistors, such as N-type transistors, wherein each of the N-type transistors is turned on when a high level signal is input at a gate thereof. This is not limited in the present application.

As shown in FIG. 4, the driving resetting sub-circuit 10 comprises a first transistor T1.

The first transistor T1 has a gate electrically connected to the first resetting signal terminal RST1, a first electrode electrically connected to the gate of the driving transistor Td, and a second electrode electrically connected to the first initial voltage terminal $V_{int1}$.

It should be noted that the driving resetting sub-circuit 10 may further comprise a plurality of switching transistors connected in parallel with the first transistor T1. The above description is merely an example of the driving resetting sub-circuit 10. Other structures having the same functions as those of the driving resetting sub-circuit 10 will not be described here again, and should fall within the protection scope of the present application.

As shown in FIG. 4, the writing compensation sub-circuit 20 comprises a second transistor T2 and a third transistor T3.

The second transistor T2 has a gate electrically connected to the scanning signal terminal S, a first electrode electrically connected to the gate of the driving transistor Td, and a second electrode electrically connected to the drain of the driving transistor Td.

The third transistor T3 has a gate electrically connected to the scanning signal terminal S, a first electrode electrically connected to the data voltage terminal D, and a second electrode electrically connected to the source of the driving transistor Td.

It should be noted that the writing compensation sub-circuit 20 may further comprise a plurality of switching transistors connected in parallel with the second transistor T2, and/or a plurality of switching transistors connected in parallel with the third transistor T3. The above description is merely an example of the writing compensation sub-circuit 20. Other structures having the same functions as those of the writing compensation sub-circuit 20 will not be described here again, and should fall within the protection scope of the present application.

As shown in FIG. 4, the light-emitting resetting sub-circuit 30 comprises a fourth transistor T4.

The fourth transistor T4 has a gate electrically connected to the scanning signal terminal S, a first electrode electrically connected to the first initial voltage terminal $V_{int1}$, and a second electrode electrically connected to the light-emitting device L.

Here, the light-emitting device L comprises a light-emitting diode, which may be a semiconductor light-emitting diode or an organic light-emitting diode. The second electrode of the fourth transistor T4 is electrically connected to an anode of the light-emitting diode.

It should be noted that the light-emitting resetting sub-circuit 30 may further comprise a plurality of switching transistors connected in parallel with the fourth transistor T4. The above description is merely an example of the light-emitting resetting sub-circuit 30. Other structures having the same functions as that of the light-emitting resetting sub-circuit 30 will not be described here again, and should fall within the protection scope of the present application.

As shown in FIG. 4, the light-emitting enabling sub-circuit 40 comprises a fifth transistor T5 and a sixth transistor T6.

The fifth transistor T5 has a gate electrically connected to the enabling signal terminal EM, a first electrode electrically connected to the first power supply voltage terminal ELVDD, and a second electrode electrically connected to the source of the driving transistor Td.

The sixth transistor T6 has a gate electrically connected to the enabling signal terminal EM, a first electrode electrically connected to the drain of the driving transistor Td, and a second electrode electrically connected to the light-emitting device L.

That is, if the light-emitting device L is a light-emitting diode, the second electrode of the sixth transistor T6 is electrically connected to an anode of the light-emitting diode.

A cathode of the light-emitting diode is electrically connected to the second power supply voltage terminal ELVSS. Here, in the present application, the first power supply voltage terminal ELVDD outputs a constant high voltage, and the second power supply voltage terminal ELVSS outputs a constant low voltage.

It should be noted that the light-emitting enabling sub-circuit 40 may further comprise a plurality of switching transistors connected in parallel with the fifth transistor T5 and/or a plurality of switching transistors connected in parallel with the sixth transistor T6. The above description is merely an example of the light-emitting enabling sub-circuit 40. Other structures having the same functions as that of the light-emitting enabling sub-circuit 40 will not be described here again, and should fall within the protection scope of the present application.

Figure 5A:
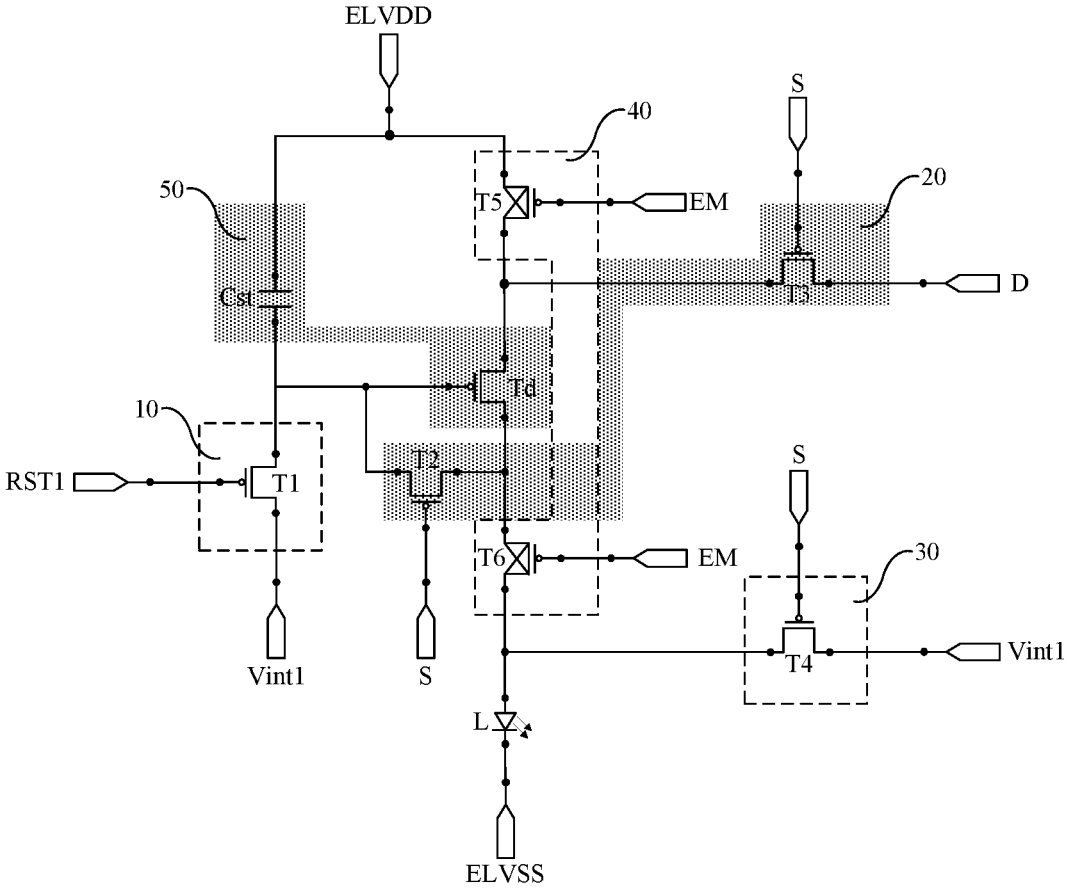

Based on the above description of a specific circuit of each sub-circuit, in the blanking phase, when the scanning signal terminal S and the first resetting signal terminal RST1 output a low level signal, the enabling signal terminal EM outputs a high level signal, and the data voltage terminal D outputs the reference voltage at a high level (the voltage is denoted as $V_D$), an equivalent circuit diagram of the pixel circuit shown in FIG. 4 is as shown in FIG. 5*a*, wherein the first transistor T1, the second transistor T2, the third transistor T3, and the four transistors T4 are all turned on (transistors which are in a turn-off state are indicated by "x").

The first transistor T1 and the second transistor T2 are turned on, so that the voltage at the first initial voltage terminal $V_{int1}$ is input to the gate and the drain of the driving transistor Td; and the third transistor T3 is turned on, so that the reference voltage (the voltage is denoted as $V_D$) output at the data voltage terminal D is input to the source of the driving transistor. Thereby, Vgs of the driving transistor Td is equal to $V_{int1}$-$V_D$, and the driving transistor Td is in an On-Bias state. In this way, in the pixel circuits of the sub-pixels of the display panel, all the driving transistors Td are in an On-Bias state, and writing of the data voltage and compensation of the threshold voltage are performed on the driving transistors Td in the same state regardless of a data voltage of a previous frame, thereby improving the short-term afterimage problem caused by the hysteresis effect. In the present application, the reference voltage $V_D$ output at the data voltage terminal D should satisfy $V_{int1}-V_D<-|Vth|$ (wherein Vth is the threshold voltage of the driving transistor Td), so that when $V_D$ is input to the source of the driving transistor and $V_{int1}$ is input to the gate of the driving transistor, the driving transistor Td is in an On-Bias state.

The embodiments of the present application further provide a display substrate, as shown in FIG. 6, comprising sub-pixels disposed in an array, wherein each of the sub-pixels comprises the pixel circuit described above. Here, in FIG. 6, the rectangular blocks represents pixel circuits.

For example, a plurality of pixel circuits are arranged in an array on the display substrate, wherein the scanning signal terminals S of the pixel circuits in a row of sub-pixels may be electrically connected to a scanning signal line CL. A first resetting signal terminal RST1 may be electrically connected to a scanning signal line CL of a previous row of sub-pixels. When a low level signal is input to the scanning signal line CL of the previous row of sub-pixels, a driving resetting sub-circuit 10 in a next row of pixel circuit resets a gate of a driving transistor Td.

Based thereon, in the blanking phase, the first resetting signal terminals RST1 in pixel circuits of a first row of sub-pixels output a low level signal, all the scanning signal lines CL output a low level signal, the enabling signal terminal EM outputs a high level signal and the data voltage terminal D outputs the reference voltage at a high level (the voltage is denoted as $V_D$), so that Vgs of driving transistors in the pixel circuits of all sub-pixels may be reset at the same time (to $V_{int1}$-$V_D$).

Optionally, as shown in FIG. 7, the display substrate further comprises a plurality of switching sub-circuits 60. Each of the switching sub-circuits 60 is electrically connected to a gate line CL, and all the switching sub-circuits 60 are electrically connected to the second resetting signal terminal RST2 and the second initial voltage terminal $V_{int2}$. Each of the switching sub-circuits 60 is configured to input the voltage provided at the second initial voltage terminal $V_{int2}$ to a corresponding gate line CL under the control of the second resetting signal terminal RST2, so that a corresponding writing compensation sub-circuit 20 inputs the reference voltage output at the data voltage terminal D to a source of a driving transistor Td in a corresponding driving sub-circuit 50 in the blanking phase.

That is, the voltage provided at the second initial voltage terminal $V_{int2}$ is input to all the gate lines CL under the control of the second resetting signal terminal RST2, and the reference voltage output at the data voltage terminal D may be input to sources of all the driving transistors Td under the control of the second initial voltage terminal $V_{int2}$. In this case, when a first resetting signal terminal RST1 in a row of pixel circuit is electrically connected to a scanning signal line CL of a previous row of pixel circuit, the voltage at the first initial voltage terminal $V_{int1}$ may be input to a gate of a corresponding driving transistor Td. In this way, Vgs of the driving transistors in the pixel circuits of all the sub-pixels may be reset at the same time.

It should be noted that the voltage at the second initial voltage terminal $V_{int2}$ should be less than the voltage at the first initial voltage terminal $V_{int1}$ to ensure that the reference voltage output at the data voltage terminal D can be input to the sources of all the driving transistors Td under the control of the second initial voltage terminal $V_{int2}$.

In this way, it only needs to control the signals at the second resetting signal terminal RST2 and the second initial voltage terminal $V_{int2}$, to cause the reference voltage output at the data voltage terminal D to be input to the sources of the driving transistors Td, which makes the control process simpler.

Further, as shown in FIG. 7, the switching sub-circuit 60 comprises a seventh transistor T7.

The seventh transistor T7 has a gate electrically connected to the second resetting signal terminal RST2, a first electrode electrically connected to the gate line CL, and a second electrode electrically connected to the second initial voltage terminal $V_{int2}$.

The embodiments of the present application further provide a display apparatus comprising the display substrate described above.

The embodiments of the present application further provide a method for driving the pixel circuit described above. As shown in FIG. 8, the method comprises the following steps.

In S10, in a resetting phase P1 of an image frame (as shown in FIG. 9), the driving resetting sub-circuit 10 resets the driving sub-circuit 50 through the first initial voltage terminal $V_{int1}$ under the control of the first resetting signal terminal RST1.

Figure 5B:
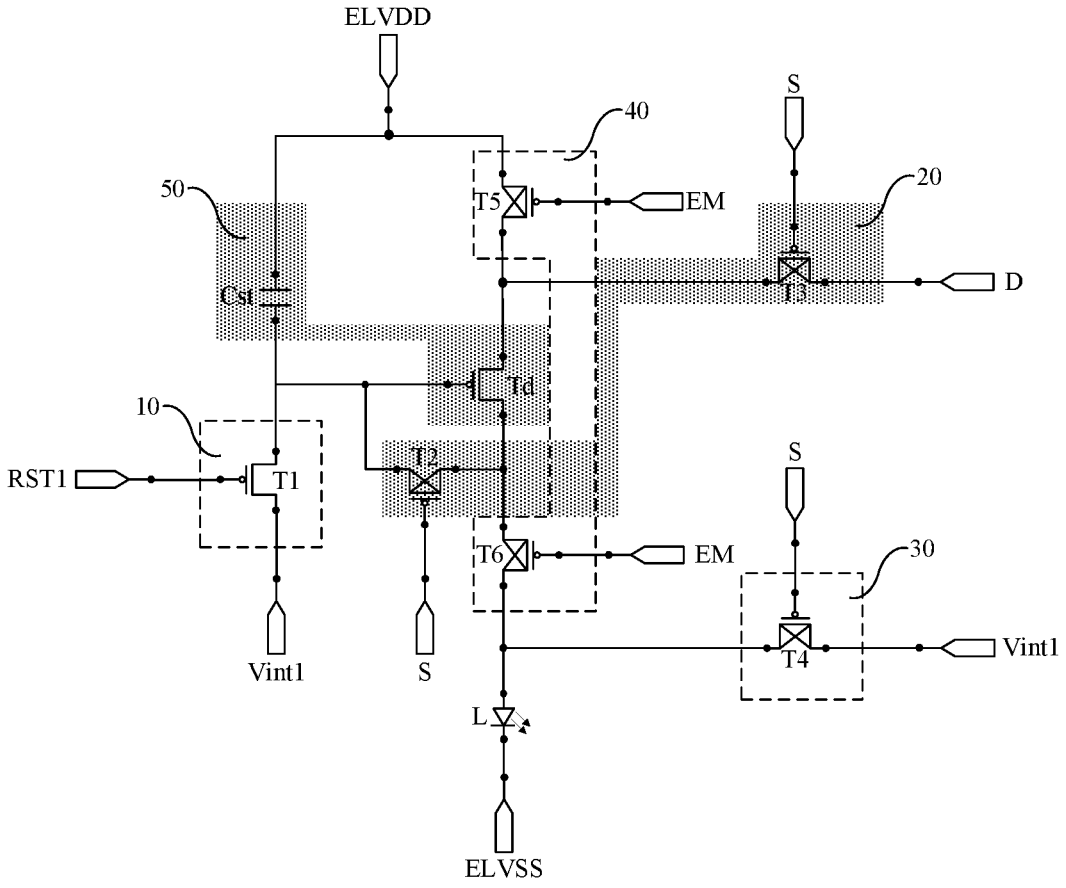

Specifically, when the first resetting signal terminal RST1 outputs a low level signal, and the scanning signal terminal S and the enabling signal terminal EM output a high level signal, the equivalent circuit diagram of a pixel circuit shown in FIG. 4 is as shown in FIG. 5*b*, in which the first transistor T1 is turned on.

The turn-on of the first transistor T1 enables a voltage at the first initial voltage terminal $V_{int1}$ to be input to the gate of the driving transistor Td so as to reset the gate of the driving transistor Td, so that a voltage at the gate is equal to the voltage at the first initial voltage terminal $V_{int1}$, and the turn-on of the first transistor T1 enables the storage capacitor Cst to be charged so as to reset the storage capacitor Cst.

It should be noted that in a case where the first resetting signal terminals RST1 in the pixel circuits of a row of sub-pixels are electrically connected to a scanning signal line CL connected to a previous row of sub-pixels, when the scanning signal line CL connected to the previous row of sub-pixels outputs a low level signal, the first resetting signal terminals RST1 in the pixel circuits of the current row of sub-pixels output a low level signal.

In S11, in a writing compensation phase P2 of the image frame (as shown in FIG. 9), the writing compensation sub-circuit 20 provides a data voltage to the driving sub-circuit 50 through the data voltage terminal D and performs data compensation on the driving sub-circuit 50 under the control of the scanning signal terminal S; and at the same time, the light-emitting resetting sub-circuit 30 resets the light-emitting device L through the first initial voltage terminal $V_{int1}$ under the control of the scanning signal terminal S.

Figure 5C:
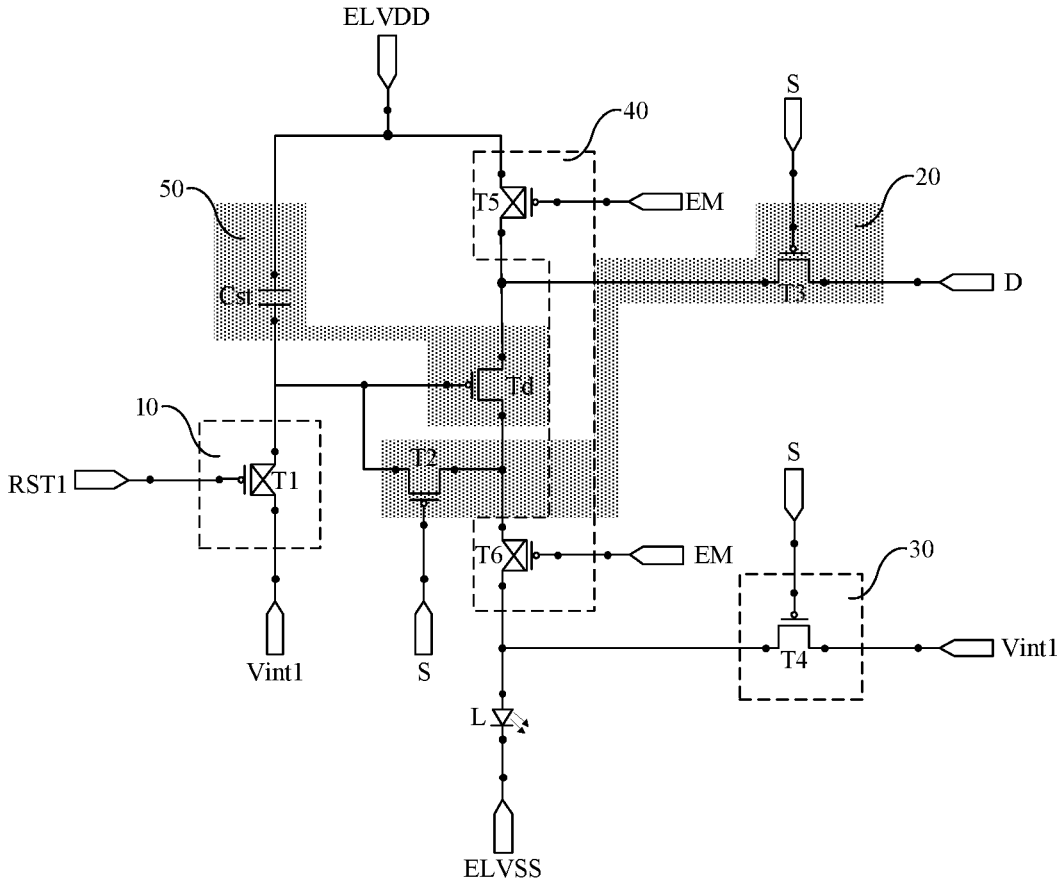

Specifically, when the scanning signal terminal S outputs a low level signal, and the first resetting signal terminal RST1 and the enabling signal terminal EM output a high level signal, the equivalent circuit diagram of a pixel circuit shown in FIG. 4 is as shown in FIG. 5*c*, in which the second transistor T2, the third transistor T3, and the fourth transistor T4 are turned on.

The turn-on of the third transistor T3 may enable the data voltage (denoted as $V_{data}$) output at the data voltage terminal D to be input to the source of the driving transistor Td. At this time, the potential at the first electrode is $V_{data}$, $Vgs=V_{int1}-V_{data}<-|Vth|$, and the driving transistor Td is turned on. The turn-on of the second transistor T2 enables the gate of the driving transistor Td to be electrically connected to the drain of the driving transistor, to charge the storage capacitor Cst. At the same time, the storage capacitor Cst discharges the gate of the driving transistor Td until the voltage at the gate reaches $V_{data}$-|Vth|, and the charging stops. By taking a P-type enhancement transistor that is turned on when Vgs<−|Vth| as an example, when the voltage at the gate of the driving transistor Td reaches $V_{data}$-|Vth|, the driving transistor Td is turned off, and at the time, data writing and data compensation are completed.

Further, the turn-on of the fourth transistor T4 enables the voltage at the first initial voltage terminal $V_{int1}$ to be input to the anode of the light-emitting device L so as to reset charges remaining on the anode of the light-emitting device L, so as to protect the light-emitting device L.

It should be noted that in a case where the first resetting signal terminals RST1 in the pixel circuits of a row of sub-pixels are electrically connected to a scanning signal line CL connected to a previous row of sub-pixels, when the scanning signal line CL connected to the previous row of sub-pixels outputs a high level signal, the first resetting signal terminals RST1 of the pixel circuits in the sub-pixels connected to the scanning signal line CL output a high level signal.

In S12, in a light-emitting phase P3 of the image frame (as shown in FIG. 9), the light-emitting enabling sub-circuit 40 provides a voltage provided at the first power supply voltage terminal ELVDD to the driving sub-circuit 50 and connects the driving sub-circuit 50 to the light-emitting device L under the control of the enabling signal terminal EM, and the driving sub-circuit 50 provides a driving current to the light-emitting device L.

Figure 5D:
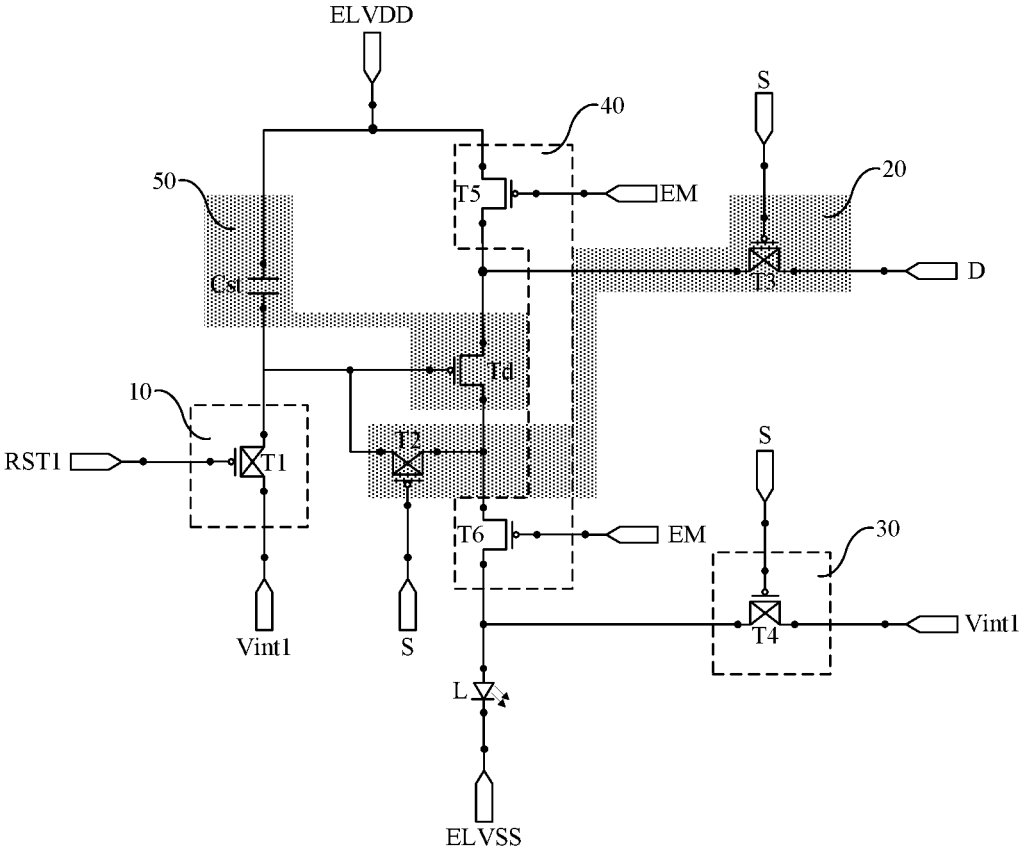

When the enabling signal terminal EM outputs a low level signal, and the first resetting signal terminal RST1 and the scanning signal terminal S output a high level signal, the equivalent circuit diagram of a pixel circuit shown in FIG. 4 is as shown in FIG. 5*d*, in which the fifth transistor T5 and the sixth transistor T6 are turned on.

The turn-on of the fifth transistor T5 enables the voltage provided at the first power supply voltage terminal ELVDD to be input to the source of the driving transistor Td, and the turn-on of the sixth transistor T6 enables the drain of the driving transistor Td to be electrically connected to the anode of the light-emitting device L. Here, since Vgs of the driving transistor Td is equal to $V_{data}$−|Vth|−ELVDD<−|Vth|, the driving transistor Td is turned on, and the driving transistor Td provides a driving current flowing to the light-emitting device L, to cause the light-emitting device L to emit light. At this time, the current Is flowing through the light-emitting device L is:

$$\begin{aligned} Is &= 1/2 \times K \times |(Vgs - (-|Vth|))|^2 \\ &= 1/2 \times K \times |(V_{data} - |Vth| - ELVDD - (-|Vth|))|^2 \\ &= 1/2 \times K \times (ELVDD - V_{data})^2 \end{aligned}$$

where K=W/L×C×u, W/L is an aspect ratio of the driving transistor Td, C is capacitance of a channel insulating layer, and u is a channel carrier mobility.

It can be seen that the current flowing through the driving transistor Td is only related to the data voltage provided at the data voltage terminal D for realizing the display and the voltage provided at the first power supply voltage terminal ELVDD, and not dependent on the threshold voltage Vth of the driving transistor Td, thereby eliminating the influence of the threshold voltage Vth of the driving transistor Td on the brightness of the light-emitting device L, and improving the uniformity of the brightness of the light-emitting device L.

In S13, in a blanking phase P4 between adjacent image frames (as shown in FIG. 9), the driving resetting sub-circuit 10 resets the driving sub-circuit 50 through the first initial voltage terminal $V_{int1}$ under the control of the first resetting signal terminal RST1; and at the same time, the writing compensation sub-circuit 20 provides a reference voltage to the driving sub-circuit 50 through the data voltage terminal D under the control of the scanning signal terminal S, so that the driving transistor Td in the driving sub-circuit 50 is in an On-Bias state.

Specifically, when the scanning signal terminal S and the first resetting signal terminal RST1 output a low level signal, and the enabling signal terminal EM outputs a high level signal, the equivalent circuit diagram of a pixel circuit shown in FIG. 4 is as shown in FIG. 5*a*, in which the first transistor T1, the second transistor T2, and the third transistor T3 are all turned on.

The turn-on of the first transistor T1 and the second transistor T2 enables the voltage at the first initial voltage terminal $V_{int1}$ to be input to the gate and the drain of the driving transistor Td; and the turn-on of the third transistor T3 enables the reference voltage (denoted as $V_D$) output at the data voltage terminal D to be input to the source of the driving transistor Td. In this way, Vgs of all driving transistors Td is equal to $V_{int1}$-$V_D$, and the driving transistors Td are turned on. In this way, writing and compensation of the data voltage are performed on the driving transistors Td in the same state, regardless of a data voltage of a previous frame, thereby improving the short-term afterimage problem caused by the hysteresis effect. In the present application, the reference voltage $V_D$ output at the data voltage terminal D and the data voltage $V_{data}$ output at the data voltage terminal D may be the same or different.

It should be noted that when the first resetting signal terminals RST1 in the pixel circuits of a row of sub-pixels are electrically connected to a scanning signal line CL of a previous row of sub-pixels, it only needs to control all the gate lines CL to output a low level signal. Of course, if the first resetting signal terminals RST1 in the pixel circuits of a first row of sub-pixels also output a low level signal, all the driving transistors Td may be caused to be turned on, and Vgs of the driving transistors Td is equal to $V_{int1}$-$V_D$.

In addition, after the blanking phase, in a resetting phase of a next image frame, the gate of the driving transistor Td is reset, which may enable Vgs of the driving transistor Td to be kept as $V_{int1}$-$V_D$ until the data voltage is written.

It should be noted that when the pixel circuit described above is applied to a display panel, a plurality of pixel circuits are arranged in an array on the display substrate. In a process of displaying an image frame, the scanning signal lines CL are turned on row by row to complete display of the image frame. After the P1 to P3 phases are completed for the pixel circuits in all rows of sub-pixels, all the pixel circuits enter the blanking phase P4.

Further, as shown in FIG. 9, there is further a first transition phase P0 between the blanking phase and a resetting phase P1 of a next image frame; and there is further a second transition phase P2' between the data writing phase P2 and the light-emitting phase P3 of the image frame. For example, in the first transition phase P0, the signals at the scanning signal terminal S, the first resetting signal terminal RST1, the enabling signal terminal EM, and the data voltage terminal D may be inverted to ensure that the corresponding signal terminals output an active level according to a timing in the subsequent phases. It can be understood that the duration in which the enabling signal terminal EM is at an active level should be longer than the duration in which the scanning signal terminal S is at an active level and the duration in which the data voltage terminal D is at an active level. The second transition phase P2' is provided to ensure that the data voltage is written into the driving transistor, thereby ensuring that the light-emitting diode receives a correct driving current in the light-emitting phase.

When the pixel circuits are disposed in sub-pixels of the display substrate, the scanning signal terminals S in the pixel circuits of each row of sub-pixels are electrically connected to a scanning signal line CL, and the first resetting signal terminals RST1 in the pixel circuits of the row of sub-pixels are electrically connected to a scanning signal line CL of a previous row of sub-pixels (as shown in FIG. 6), during the display of an image frame, the scanning signal lines CL input a scanning signal row by row, and the data signal terminal D outputs a data voltage, so that the pixel circuits in each row of sub-pixels perform the above driving processes of S10 and S11, and the pixel circuits in each row of sub-pixels perform the driving process of S12 under the control of the enabling signal terminal EM. After the image frame is displayed completely, the process proceeds to a blanking phase in which all the scanning signal lines CL input a scanning signal at the same time and the data signal terminal D outputs a reference voltage to perform the above driving process of S13.

The embodiments of the present application further provide a method for driving a display substrate, wherein the display substrate comprises at least one sub-pixel, and each of the at least one sub-pixel comprises the pixel circuit described above, wherein the scanning signal terminals S of the pixel circuits in each row of sub-pixels are electrically connected to a scanning signal line CL, each switching sub-circuit 60 is electrically connected to a gate line CL, and all the switching sub-circuits 60 are electrically connected to the second resetting signal terminal RST2 and the second initial voltage terminal $V_{int2}$ (as shown in FIG. 7).

As shown in FIG. 10, the driving method comprises the following steps.

In S20, in a resetting phase P1 of an image frame (as shown in FIG. 11), the driving resetting sub-circuit 10 resets the driving sub-circuit 50 through the first initial voltage terminal $V_{int1}$ under the control of the first resetting signal terminal RST1.

For details of this step, refer to the above description at S10.

In S21, in a writing compensation phase P2 of the image frame (as shown in FIG. 11), the writing compensation sub-circuit 20 provides a data voltage to the driving sub-circuit 50 through the data voltage terminal D and performs data compensation on the driving sub-circuit 50 under the control of the scanning signal terminal S; and at the same time, the light-emitting resetting sub-circuit 30 resets the light-emitting device L through the first initial voltage terminal $V_{int1}$ under the control of the scanning signal terminal S.

For details of this step, refer to the above description at S11.

In S22, in a light-emitting phase P3 of the image frame (as shown in FIG. 11), the light-emitting enabling sub-circuit 40 provides a voltage provided at the first power supply voltage terminal ELVDD to the driving sub-circuit 50 and connects the driving sub-circuit 50 to the light-emitting device L under the control of the enabling signal terminal EM, and the driving sub-circuit 50 provides a driving current to the light-emitting device L.

For details of this step, refer to the above description at S12.

In S23, in a blanking phase between adjacent image frames (as shown in FIG. 11), the driving resetting sub-circuit 10 resets the driving sub-circuit 50 through the first initial voltage terminal $V_{int1}$ under the control of the first resetting signal terminal RST1; and at the same time, the voltage provided at the second initial voltage terminal $V_{int2}$ is input to the gate line CL through the switching sub-circuit 60 under the control of the second resetting signal terminal RST2, so that the writing compensation sub-circuit 20 provides a reference voltage to the driving sub-circuit 50 through the data voltage terminal D, and thereby the driving transistor Td in the driving sub-circuit 50 is in an On-Bias state.

For pixel circuits of all sub-pixels, when the voltage provided at the second initial voltage terminal $V_{int2}$ is input to a gate line CL, the scanning signal terminals S connected to the gate line CL output a low level signal under the control of the signal output at the second resetting signal terminal RST2, so that the scanning signal terminals S output a low level signal. Of course, the first resetting signal terminals RST1 connected to the gate line CL may also output a low level signal.

For details of this step, refer to the above description at S13.

It should be noted that, as shown in FIG. 11, there is further a first transition phase P0 between the blanking phase P4 and a resetting phase P1 of a next frame; and there is further a second transition phase P2' between the data writing phase P2 and the light-emitting phase P3 of the image frame. For example, in the first transition phase P0, the signals at the scanning signal terminal S, the first resetting signal terminal RST1, the enabling signal terminal EM, and the data voltage terminal D may be inverted to ensure that the corresponding signal terminals output an active level according to a timing in the subsequent phases. It can be understood that the duration in which the enabling signal terminal EM is at an active level should be longer than the duration in which the scanning signal terminal S is at an active level and the duration in which the data voltage terminal D is at an active level. The second transition phase P2' is provided to ensure that the data voltage is written into the driving transistor, thereby ensuring that the light-emitting diode receives a correct driving current in the light-emitting phase.

The above description is merely specific embodiments of the present application, but the protection scope of the present application is not limited thereto. Changes or substitutions which are easily obtained by any skilled in the art within the technical scope disclosed in the present application should be included in the protection scope of the present application. Therefore, the protection scope of the present application should be determined by the protection scope of the claims.

We claim:

1. A pixel circuit, comprising: a driving resetting sub-circuit, a writing compensation sub-circuit, a light-emitting resetting sub-circuit, a light-emitting enabling sub-circuit, a driving sub-circuit and a light-emitting device, wherein the driving sub-circuit comprises a driving transistor having a source connected to the writing compensation sub-circuit;

the driving resetting sub-circuit is connected to a first resetting signal terminal, a first initial voltage terminal and the driving sub-circuit respectively, and is configured to input a voltage provided at the first initial voltage terminal to a gate of the driving transistor in the driving sub-circuit so as to reset the driving sub-circuit under the control of the first resetting signal terminal;

the writing compensation sub-circuit is connected to a scanning signal terminal, a data voltage terminal and the driving sub-circuit respectively, and is configured to input a data voltage output at the data voltage terminal to the driving sub-circuit and perform data compensation on the driving sub-circuit under the control of the scanning signal terminal; and configured to input a reference voltage output at the data voltage terminal to the driving sub-circuit under the control of the scanning signal terminal so that the driving transistor is in an On-Bias state when the driving resetting sub-circuit inputs the voltage provided at the first initial voltage terminal to the gate of the driving transistor in the driving sub-circuit so as to reset the driving sub-circuit under the control of the first resetting signal terminal;

the light-emitting resetting sub-circuit is connected to the scanning signal terminal, the first initial voltage terminal and the light-emitting device respectively, and is configured to input the voltage provided at the first initial voltage terminal to the light-emitting device so as to reset the light-emitting device under the control of the scanning signal terminal;

the light-emitting enabling sub-circuit is connected to an enabling signal terminal, a first power supply voltage terminal, the driving sub-circuit and the light-emitting device respectively, and is configured to provide a voltage at the first power supply voltage terminal to the driving sub-circuit and connect the driving sub-circuit to the light-emitting device under the control of the enabling signal terminal; and the driving sub-circuit is configured to provide a driving current to the light-emitting device.

2. The pixel circuit according to claim 1, wherein the driving sub-circuit is further connected to the first power supply voltage terminal;

the driving sub-circuit further comprises a storage capacitor;

the gate of the driving transistor is electrically connected to the driving resetting sub-circuit and the writing compensation sub-circuit, and a first electrode and a second electrode of the driving transistor are both electrically connected to the light-emitting enabling sub-circuit and the writing compensation sub-circuit; and the storage capacitor has a terminal electrically connected to the gate of the driving transistor, and another terminal electrically connected to the first power supply voltage terminal.

3. The pixel circuit according to claim 1, wherein the driving resetting sub-circuit comprises a first transistor, wherein the first transistor has a gate electrically connected to the first resetting signal terminal, a first electrode electrically connected to the gate of the driving transistor, and a second electrode electrically connected to the first initial voltage terminal.

4. The pixel circuit according to claim 1, wherein the writing compensation sub-circuit comprises a second transistor and a third transistor, wherein the second transistor has a gate electrically connected to the scanning signal terminal, a first electrode electrically connected to the gate of the driving transistor, and a second electrode electrically connected to a drain of the driving transistor; and the third transistor has a gate electrically connected to the scanning signal terminal, a first electrode electrically connected to the data voltage terminal, and a second electrode electrically connected to the source of the driving transistor.

5. The pixel circuit according to claim 1, wherein the light-emitting resetting sub-circuit comprises a fourth transistor, wherein the fourth transistor has a gate electrically connected to the scanning signal terminal, a first electrode electrically connected to the first initial voltage terminal, and a second electrode electrically connected to the light-emitting device.

6. The pixel circuit according to claim 1, wherein the light-emitting enabling sub-circuit comprises a fifth transistor and a sixth transistor, wherein the fifth transistor has a gate electrically connected to the enabling signal terminal, a first electrode electrically connected to the first power supply voltage terminal, and a second electrode electrically connected to the source of the driving transistor; and the sixth transistor has a gate electrically connected to the enabling signal terminal, a first electrode electrically connected to the drain of the driving transistor, and a second electrode electrically connected to the light-emitting device.

7. The pixel circuit according to claim 1, wherein the light-emitting device comprises a light-emitting diode, wherein the light-emitting diode has an anode electrically connected to the light-emitting enabling sub-circuit and the light-emitting resetting sub-circuit, and a cathode electrically connected to a second power supply voltage terminal.

8. A display substrate, comprising sub-pixels disposed in an array, wherein each of the sub-pixels comprises the pixel circuit according to claim 1.

9. The display substrate according to claim 8, wherein the scanning signal terminals of all pixel circuits in a row of sub-pixels are connected to a gate line; the display substrate further comprises at least one switching sub-circuit, wherein each of the at least one switching sub-circuit is connected to a gate line, and all of the at least one switching sub-circuit is connected to a second resetting signal terminal and a second initial voltage terminal; and the switching sub-circuit is configured to input a voltage provided at the second initial voltage terminal to the gate line under the control of the second resetting signal terminal, so that the writing compensation sub-circuit inputs the reference voltage output at the data voltage terminal to the driving sub-circuit in a blanking phase.

10. The display substrate according to claim 9, wherein each of the at least one switching sub-circuit comprises a seventh transistor, wherein the seventh transistor has a gate electrically connected to the second resetting signal terminal, a first electrode electrically connected to the gate line, and a second electrode electrically connected to the second initial voltage terminal.

11. A display apparatus, comprising the display substrate according to claim 8.

12. The display substrate according to claim 10, wherein the driving sub-circuit is further connected to the first power supply voltage terminal;

the driving sub-circuit further comprises a storage capacitor;

the gate of the driving transistor is electrically connected to the driving resetting sub-circuit and the writing compensation sub-circuit, and a first electrode and a second electrode of the driving transistor are both electrically connected to the light-emitting enabling sub-circuit and the writing compensation sub-circuit; and the storage capacitor has a terminal electrically connected to the gate of the driving transistor, and another terminal electrically connected to the first power supply voltage terminal.

13. The display substrate according to claim 10, wherein the driving resetting sub-circuit comprises a first transistor, wherein the first transistor has a gate electrically connected to the first resetting signal terminal, a first electrode electrically connected to the gate of the driving transistor, and a second electrode electrically connected to the first initial voltage terminal.

14. The display substrate according to claim 10, wherein the writing compensation sub-circuit comprises a second transistor and a third transistor, wherein the second transistor has a gate electrically connected to the scanning signal terminal, a first electrode electrically connected to the gate of the driving transistor, and a second electrode electrically connected to a drain of the driving transistor; and the third transistor has a gate electrically connected to the scanning signal terminal, a first electrode electrically connected to the data voltage terminal, and a second electrode electrically connected to the source of the driving transistor.

15. The display substrate according to claim 10, wherein the light-emitting resetting sub-circuit comprises a fourth transistor, wherein the fourth transistor has a gate electrically connected to the scanning signal terminal, a first electrode electrically connected to the first initial voltage terminal, and a second electrode electrically connected to the light-emitting device.

16. The display substrate according to claim 10, wherein the light-emitting enabling sub-circuit comprises a fifth transistor and a sixth transistor, wherein the fifth transistor has a gate electrically connected to the enabling signal terminal, a first electrode electrically connected to the first power supply voltage terminal, and a second electrode electrically connected to the source of the driving transistor; and the sixth transistor has a gate electrically connected to the enabling signal terminal, a first electrode electrically connected to the drain of the driving transistor, and a second electrode electrically connected to the light-emitting device.

17. The display substrate according to claim 10, wherein the light-emitting device comprises a light-emitting diode, wherein the light-emitting diode has an anode electrically connected to the light-emitting enabling sub-circuit and the light-emitting resetting sub-circuit, and a cathode electrically connected to a second power supply voltage terminal.

18. A method for driving a pixel circuit, wherein the pixel circuit, comprises: a driving resetting sub-circuit, a writing compensation sub-circuit, a light-emitting resetting sub-circuit, a light-emitting enabling sub-circuit, a driving sub-circuit and a light-emitting device, wherein the driving sub-circuit comprises a driving transistor having a source connected to the writing compensation sub-circuit; the driving resetting sub-circuit is connected to a first resetting signal terminal, a first initial voltage terminal and the driving sub-circuit respectively, and is configured to input a voltage provided at the first initial voltage terminal to a gate of the driving transistor in the driving sub-circuit so as to reset the driving sub-circuit under the control of the first resetting signal terminal; the writing compensation sub-circuit is connected to a scanning signal terminal, a data voltage terminal and the driving sub-circuit respectively, and is configured to input a data voltage output at the data voltage terminal to the driving sub-circuit and perform data compensation on the driving sub-circuit under the control of the scanning signal terminal; and configured to input a reference voltage output at the data voltage terminal to the driving sub-circuit under the control of the scanning signal terminal so that the driving transistor is in an On-Bias state when the driving resetting sub-circuit inputs the voltage provided at the first initial voltage terminal to the gate of the driving transistor in the driving sub-circuit so as to reset the driving sub-circuit under the control of the first resetting signal terminal; the light-emitting resetting sub-circuit is connected to the scanning signal terminal, the first initial voltage terminal and the light-emitting device respectively, and is configured to input the voltage provided at the first initial voltage terminal to the light-emitting device so as to reset the light-emitting device under the control of the scanning signal terminal; the light-emitting enabling sub-circuit is connected to an enabling signal terminal, a first power supply voltage terminal, the driving sub-circuit and the light-emitting device respectively, and is configured to provide a voltage at the first power supply voltage terminal to the driving sub-circuit and connect the driving sub-circuit to the light-emitting device under the control of the enabling signal terminal; and the driving sub-circuit is configured to provide a driving current to the light-emitting device, the method comprising: in a resetting phase of an image frame, resetting, by the driving resetting sub-circuit, the driving sub-circuit through the first initial voltage terminal under the control of the first resetting signal terminal; in a writing compensation phase of the image frame, providing, by the writing compensation sub-circuit, a data voltage to the driving sub-circuit through the data voltage terminal, and performing data compensation on the driving sub-circuit under the control of the scanning signal terminal, while resetting, by the light-emitting resetting sub-circuit, the light-emitting device through the first initial voltage terminal under the control of the scanning signal terminal; in a light-emitting phase of the image frame, providing, by the light-emitting enabling sub-circuit, a voltage provided at the first power supply voltage terminal to the driving sub-circuit, and connecting the driving sub-circuit to the light-emitting device under the control of the enabling signal terminal, so that the driving sub-circuit provides a driving current to the light-emitting device; and in a blanking phase between adjacent image frames, resetting, by the driving resetting sub-circuit, the driving sub-circuit through the first initial voltage terminal under the control of the first resetting signal terminal, while providing, by the writing compensation sub-circuit, the reference voltage to the driving sub-circuit through the data voltage terminal under the control of the scanning signal terminal, so that the driving transistor in the driving sub-circuit is in an On-Bias state.

19. A method for driving a display substrate, wherein the display substrate comprises sub-pixels disposed in an array, wherein each of the sub-pixels comprises a pixel circuit, comprising: a driving resetting sub-circuit, a writing compensation sub-circuit, a light-emitting resetting sub-circuit, a light-emitting enabling sub-circuit, a driving sub-circuit and a light-emitting device, wherein the driving sub-circuit comprises a driving transistor having a source connected to the writing compensation sub-circuit; the driving resetting sub-circuit is connected to a first resetting signal terminal, a first initial voltage terminal and the driving sub-circuit respectively, and is configured to input a voltage provided at the first initial voltage terminal to a gate of the driving transistor in the driving sub-circuit so as to reset the driving sub-circuit under the control of the first resetting signal terminal; the writing compensation sub-circuit is connected to a scanning signal terminal, a data voltage terminal and the driving sub-circuit respectively, and is configured to input a data voltage output at the data voltage terminal to the driving sub-circuit and perform data compensation on the driving sub-circuit under the control of the scanning signal terminal; and configured to input a reference voltage output at the data voltage terminal to the driving sub-circuit under the control of the scanning signal terminal so that the driving transistor is in an On-Bias state when the driving resetting sub-circuit inputs the voltage provided at the first initial voltage terminal to the gate of the driving transistor in the driving sub-circuit so as to reset the driving sub-circuit under the control of the first resetting signal terminal; the light-emitting resetting sub-circuit is connected to the scanning signal terminal, the first initial voltage terminal and the light-emitting device respectively, and is configured to input the voltage provided at the first initial voltage terminal to the light-emitting device so as to reset the light-emitting device under the control of the scanning signal terminal; the light-emitting enabling sub-circuit is connected to an enabling signal terminal, a first power supply voltage terminal, the driving sub-circuit and the light-emitting device respectively, and is configured to provide a voltage at the first power supply voltage terminal to the driving sub-circuit and connect the driving sub-circuit to the light-emitting device under the control of the enabling signal terminal; and the driving sub-circuit is configured to provide a driving current to the light-emitting device, wherein the scanning signal terminals of all pixel circuits in a row of sub-pixels are connected to a gate line: the display substrate further comprises at least one switching sub-circuit, wherein each of the at least one switching sub-circuit is connected to a gate line, and all of the at least one switching sub-circuit is connected to a second resetting signal terminal and a second initial voltage terminal; and the switching sub-circuit is configured to input a voltage provided at the second initial voltage terminal to the gate line under the control of the second resetting signal terminal, so that the writing compensation sub-circuit inputs the reference voltage output at the data voltage terminal to the driving sub-circuit in a blanking phase, the method comprising: in a resetting phase of an image frame, resetting by, the driving resetting sub-circuit, the driving sub-circuit through the first initial voltage terminal under the control of the first resetting signal terminal; in a writing compensation phase of the image frame, providing, by the writing compensation sub-circuit, a data voltage to the driving sub-circuit through the data voltage terminal, and performing data compensation on the driving sub-circuit under the control of the scanning signal terminal; and resetting, by the light-emitting resetting sub-circuit, the light-emitting device through the first initial voltage terminal under the control of the scanning signal terminal; in a light-emitting phase of the image frame, providing, by the light-emitting enabling sub-circuit, a voltage provided at the first power supply voltage terminal to the driving sub-circuit, and connecting the driving sub-circuit to the light-emitting device under the control of the enabling signal terminal, so that the driving sub-circuit provides a driving current to the light-emitting device; and in a blanking phase between adjacent image frames, resetting, by the driving resetting sub-circuit, the driving sub-circuit through the first initial voltage terminal under the control of the first resetting signal terminal, while inputting a voltage provided at the second initial voltage terminal to the gate line through a switch sub-circuit under the control of the second resetting signal terminal, so that the writing compensation sub-circuit provides the reference voltage to the driving sub-circuit through the data voltage terminal, to cause the driving transistor in the driving sub-circuit to be in an On-Bias state.

* * * * *